US009315935B2

(12) United States Patent
Amarillas et al.

(10) Patent No.: US 9,315,935 B2
(45) Date of Patent: Apr. 19, 2016

(54) HIGH EFFICIENCY WASHING METHOD WITH WATER SAVINGS

(75) Inventors: Santiago Alonso Plata Amarillas, Santiago de Queretaro (MX); Erick Flores Islas, Santiago de Queretaro (MX); Edgar Rene Aranda Sanchez, Santiago de Queretaro (MX); Jorge Vega Trejo, Santiago de Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 1589 days.

(21) Appl. No.: 12/904,437

(22) Filed: Oct. 14, 2010

(65) Prior Publication Data

US 2011/0099726 A1 May 5, 2011

(30) Foreign Application Priority Data

Oct. 15, 2009 (MX) ..... MX/a/2009/011126

(51) Int. Cl.
*D06L 1/20* (2006.01)
*D06F 33/00* (2006.01)

(52) U.S. Cl.
CPC .. *D06F 33/00* (2013.01); *D06L 1/20* (2013.01)

(58) Field of Classification Search
CPC ..... D06L 1/20; D06F 33/00
USPC ..... 8/137, 147, 158, 159; 68/3 R, 12.01, 68/12.02
See application file for complete search history.

(56) References Cited

U.S. PATENT DOCUMENTS 4,449,079 A * 5/1984 Erdman ..... 318/400.31
4,986,093 A 1/1991 Pastryk et al.
5,208,931 A * 5/1993 Williams et al. ..... 8/159
5,726,546 A * 3/1998 Harwood ..... 318/400.1
5,737,790 A * 4/1998 Badger et al. ..... 8/158
5,768,728 A * 6/1998 Harwood et al. ..... 8/158
5,838,127 A * 11/1998 Young et al. ..... 318/293
6,038,724 A * 3/2000 Chbat et al. ..... 8/159
6,189,171 B1 * 2/2001 Savkar et al. ..... 8/159
6,269,666 B1 * 8/2001 Whah et al. ..... 68/12.02
6,665,899 B2 12/2003 Lee et al.
6,978,554 B2 * 12/2005 Stinnett et al. ..... 34/527
7,376,997 B2 * 5/2008 Kim et al. ..... 8/159
7,434,424 B2 * 10/2008 Lueckenbach et al. ..... 68/12.02

(Continued)

FOREIGN PATENT DOCUMENTS

EP 0668389 8/1995
JP 01317484 12/1989

(Continued)

*Primary Examiner* — Michael Barr
*Assistant Examiner* — Benjamin L Osterhout
(74) *Attorney, Agent, or Firm* — Terry M. Sanks, Esq.; Beusse Wolter Sanks & Maire, PLLC

(57) ABSTRACT

The present invention relates to a top loading household washer comprising a cabinet supporting a tub which houses a basket being driven by a motor mechanically coupled to an agitator and to said basket, a clutch, an electric control, a level sensor or pressure switch and a rotor position sensor within the motor (preferably a Hall sensor), a spraying system, characterized by a washing method comprising: check on the water level, initiate a load pre-sensing sequence to later initiate a reshuffling of load sequence, act followed by initiating a load sensing sequence, which determines the water level required to admit, once said water level is reached, a normal agitation sequence is begun; once the normal agitation sequence concludes, it is followed by a load reshuffling sequence to continue with the dehydrating and later rinsing.

6 Claims, 5 Drawing Sheets

(56) References Cited

U.S. PATENT DOCUMENTS

| | | | | |
|---|---|---|---|---|
| 2004/0112096 | A1* | 6/2004 | Stephens | 68/12.02 |
| 2005/0071930 | A1* | 4/2005 | Bruntz | 8/158 |
| 2007/0113595 | A1* | 5/2007 | Harwood et al. | 68/12.01 |

FOREIGN PATENT DOCUMENTS

| | | |
|---|---|---|
| JP | 03215294 | 9/1991 |
| JP | 03244495 | 10/1991 |
| JP | 2004016483 | 1/2004 |
| KR | 890003477 | 9/1989 |
| KR | 20030029728 | 4/2003 |
| KR | 20040046216 | 6/2004 |
| KR | 20040046238 | 6/2004 |
| KR | 20040046239 | 6/2004 |
| KR | 20040046240 | 6/2004 |
| KR | 20040046241 | 6/2004 |

* cited by examiner

HIGH EFFICIENCY WASHING METHOD WITH WATER SAVINGS

RELATED APPLICATIONS

This application claims priority from Mexican application Serial No. MX/a/2009/011126 filed Oct. 15, 2009, which is incorporated herein by reference in its entirety.

FIELD OF INVENTION

The present refers to a washing method, specifically a washing method in automatic washing machines with a basket which rotates concentrically within a tub, where said basket is impelled by a motor, where the washing method itself checks on water level through the cycles, pre-senses the wash load, shakes to readjust, senses the load, shakes normally and shakes to readjust the load.

BACKGROUND

The present invention relates to the field of household automatic washers, which have recently focused an increasing interest in water consumption, as well as their energy use. This has directed focus on the ability to design various alternatives which allow for rational use of this vital liquid, as well as rational use of energy. On the other hand, some types of washers, like for example front loading washers, since they use small amounts of water, in many cases have compromised the efficiency of stain removal, where the wash cycle is longer, or being forced to use some means to elevate water temperature (a process which itself consumes high amounts of energy), in order to maximize the chemical power of the detergents or other additives mixed with the water to create the washing mixture.

Said front loading or horizontal axis washers face the above described problems, where water consumption is reduced in comparison with top loading or vertical axis, they undergo much longer cycles as well as the need to heat up water, thus increasing energy consumption. Since they are not fitted with an agitator or propeller, large water flows are not created which would have the ability to permeate through the weave of the articles to be washed, and since it is also not fitted with scrubbers, the scrubbing effect does not take place, thus their surfaces do not create friction with the objects to be washed. The above mentioned front loading or horizontal axis washers, similarly require some ties grasped unto the length of the cylinder or basket which aid in turning and mixing the clothes, causing friction between said clothes as well as against the referred to ties and the basket's interior surface. These significant differences, on one hand cause the wash cycles in a front loading or vertical axis washer to be longer cycles, it being evident due to low friction amongst the objects to be washed that there is less wear on them, which makes the removal of spots or dirt adhered to the fibers of the weave more difficult, with the understanding that low flow currents of the water or the washing mixture which cross said weaves in the cloth, coupled to the low friction among the same clothes, thus resorting to the chemical action of the washing mixture, which in order to maximize said detergent action, the washing mixture is heated and the wash cycle lengthened in order to attain a good washing action on the textiles or objects to be washed.

On the other hand, the top loading or vertical axis washers require high amounts of water so that the agitator or propeller can create good water flow, which coupled to the scrubbing action of the propeller or the agitator, cause friction unto the surface or weave of the objects to be washed added to the chemical action of the detergents which aid in removing spots firmly adhered to the textile fibers. This system allows for shorter washing cycles with less energy consumption but with higher water consumption.

Therefore, there exists the need for new technology which: should have low water consumption and low energy consumption, create strong water flow currents which aid in the penetration of the washing mixture through the fibers of the weave, vigorous scrubbing of the articles to be washed without damaging them, allow for the mixing of water and chemicals before the latter have any contact with the objects to be washed, which helps among other things, to begin the chemical action quickly when the mixture is homogenized, thus taking advantage of its chemical action to attain high washing efficiency. These reasons cause the thinking of a vertical loading washer which has a particular agitator or propeller, which allows washing with a low water volume. Also, there should be a washing method which aids in energy conservation, as well as efficient wash, these being among others, the objective of the present invention.

Various efforts have been made with the aim of reducing water and energy use in household washers, as is the case in Pastryk's et al U.S. Pat. No. 4,986,093, which describes a recirculation system, which is composed of a tank which mechanically adheres to the washer's tub. Said tank receives the detergent or chemicals as well as a certain water volume, the tank serves to mix the detergent with the chemicals, so that these may be poured in shower fashion unto the articles to be washed. This solution has the inconvenience of using high water volumes for the wash cycle, knowing that this takes place in traditional form, that is: the tub is filled to a certain water volume, the objects to be washed being totally immersed in the above mentioned liquid, followed by the beginning of the agitation cycle, with the variant that before said agitation, the mixture or washing mixture contained in the tank is pumped towards a nose or shower spraying the objects to be washed with the washing mixture. As can be seen, this method and tank arrangement do not contribute in great measure to substantial water nor energy savings, but indeed serve as a base for future developments, knowing that mixing water with chemical detergents before these make contact with the objects to be washed, avoids an undesired chemical attack on the textiles and betters the mixing proportions for a more uniform washing mixture, coupled to this aiding the objective of the detergent or chemicals in the wash.

A second example is Kretchman et al's EP 668 389 A1, which presents an improvement over the document above mentioned. Specifically, the space created in the lower part of the basket and the tub's bottom has been taken advantage of to store water, same which, once having a determined liquid level in this said area, detergent or washing chemicals are added, mixing to form the washing mixture, by means of a pump placed in a trough and hoses, the washing mixture is extracted and sprayed on the basket's upper part, meanwhile the bottom of the basket rotates with one or two degrees of liberty. Once again, it can be seen that if the water storage improvement in the tub's bottom is of great help, the circular and undulating movement of the basket's bottom, far from helping would be more of an artifact found at a fair. However, this does not represent an improvement with the purpose of stain or dirt removal on the objects to be washed.

Thus, in view of the problems described above, coupled to higher social conscience on the part of the consumer regarding more efficient household appliances, with more options, low cost, dependable and in particular with lower water use, the present invention has been developed.

BRIEF DESCRIPTION OF THE INVENTION

The high efficiency washing method of the present invention has the peculiarity of adapting to different washing conditions imposed by varying washing habits of the operators. So that in the washing sequences, instead of emitting a failure signal, it is always intent on continuing the washing cycle, avoiding complaints and hassles for the operator in situations like for example: overloading the articles to be washed in the washer, clothing types, additives which create too much foam, unbalancing due to larger articles etc.

The cycle of the preferred embodiment of the invention begins when the operator has introduced a determined amount of articles to be washed, optionally, a determined amount of additives for the wash, has selected a program to use and the washer has been turned on, which in turn initiates a sequencing of pre-sensing of the load, where the washer indicates if there are an excess of clothes or a load which in a preferred embodiment is reported greater than 7 kg; if no overload condition is detected the bleach admission valve is opened for a determined time to later start with the reshuffling sequence and later do a water spraying contained in the bottom of the basket to hydrate the exposed objects to be washed which are placed on the top, or in the opposite case, upon detecting the overload, the mechanical control omits the reshuffling sequence and proceeds directly to the load sensing sequence. The mentioned load sensing sequence takes place in order to determine in a more precise fashion than the load pre-sensing sequence, the amount of objects to be washed which are placed in the basket. In this way, the amount of water can be properly determined, and in a preferred embodiment of the present invention, the centrifuge pattern as well as the rinsing blocks or the required rinsing profile with the purpose of saving water. Once the sensing the amount of articles to be washed in the basket, in order to determine the wash level takes place, the overload possibility is checked again. If said overload condition does exist, an agitating sequence begins at the maximum charge with a level V or water maximum so that later the dehydrating and rinsing phases take place. In an opposite case, if there exists no overload condition, water is introduced until the predetermined level is reached (level II or minimum, level III or medium, level IV or high), beginning the sequence of normal agitation for a predetermined time, to later undergo the reshuffling sequence for another determined time. Subsequently, the dehydration takes place to ultimately rinse the objects to be washed deposited in the basket, thus finalizing the complete wash cycle.

Thus, as can be seen, this novel washing method is efficient both in energy and in water usage. Additionally, it has sequences which allow for the continuity of function in case excessive overload exists, or jamming of the articles to be washed, tangling, overloading or any other problem which can occur when washing textiles in a washing machine.

DETAILED DESCRIPTION OF THE INVENTION

Figure 1:
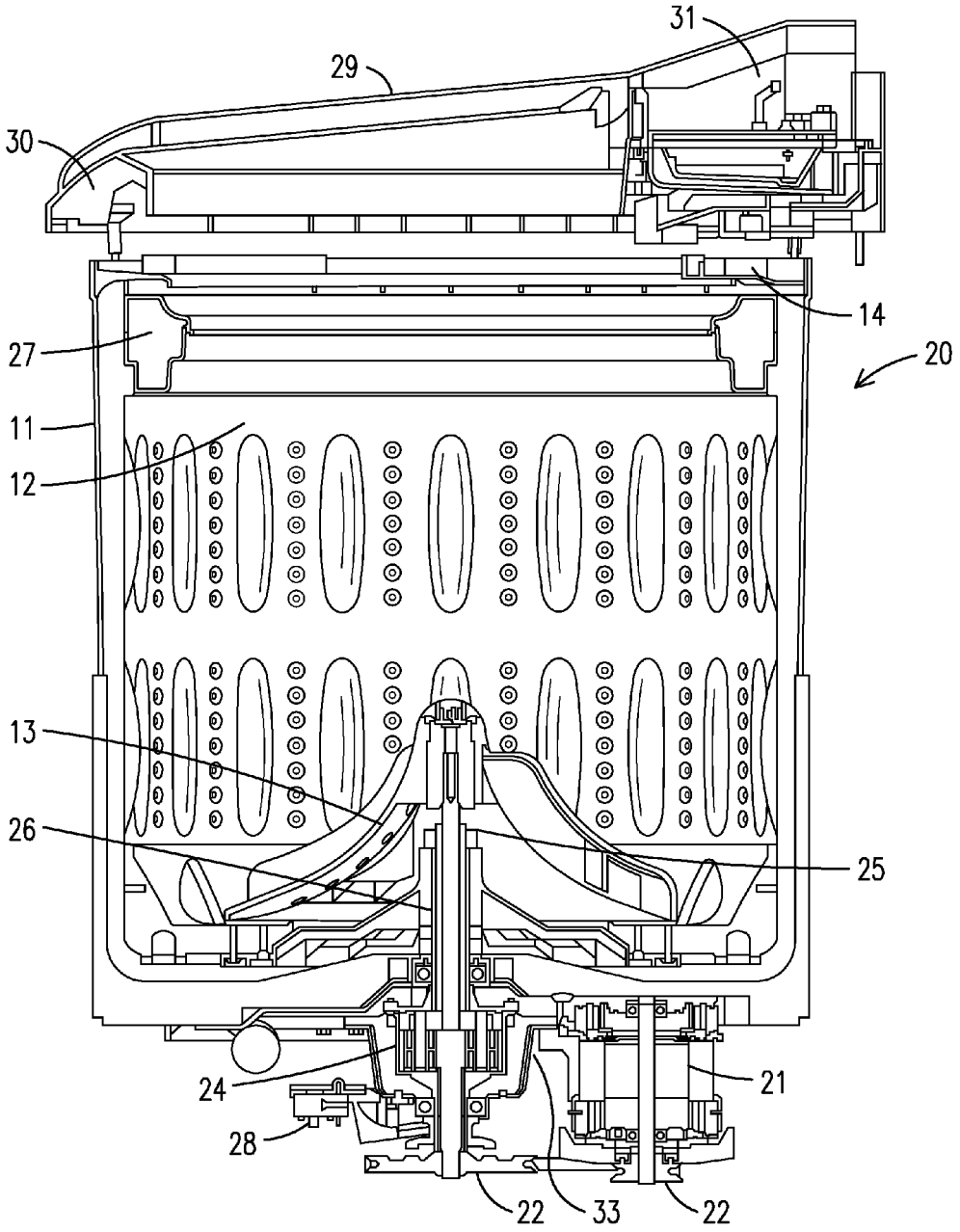
FIG. 1 is a cross section of a washer.
Figure 2:
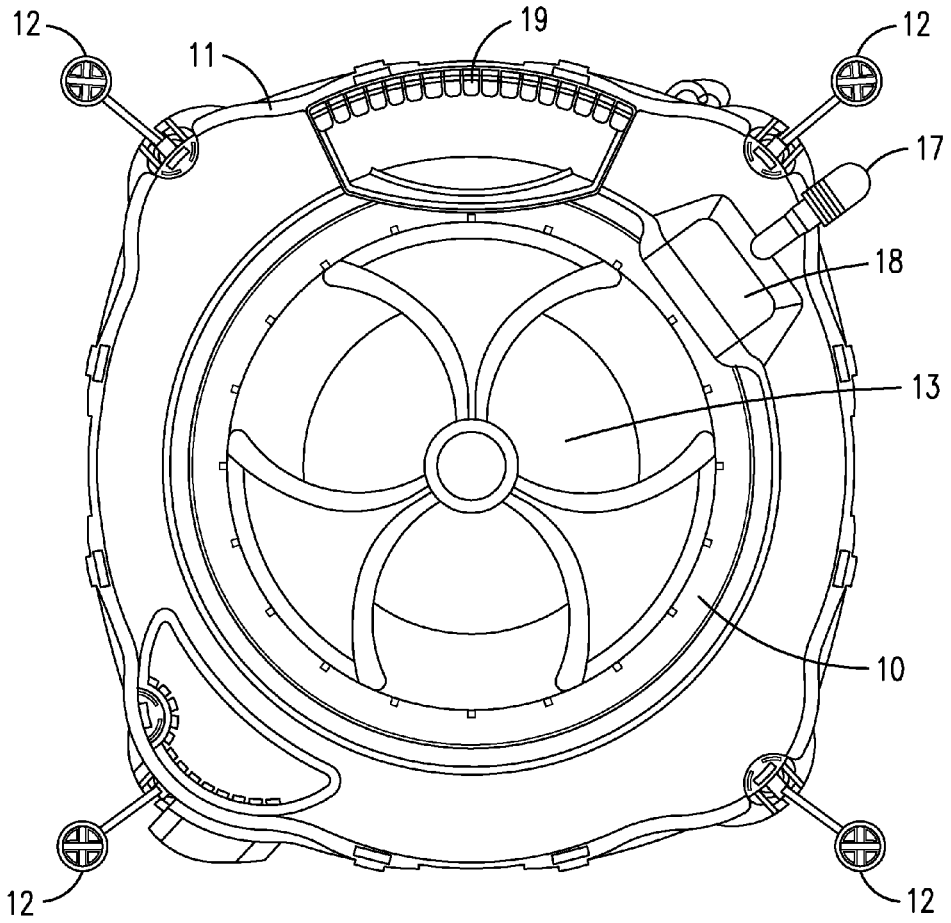
FIG. 2 is an upper view of a sub-washer, that is, a washer without cabinet.
Figure 3:
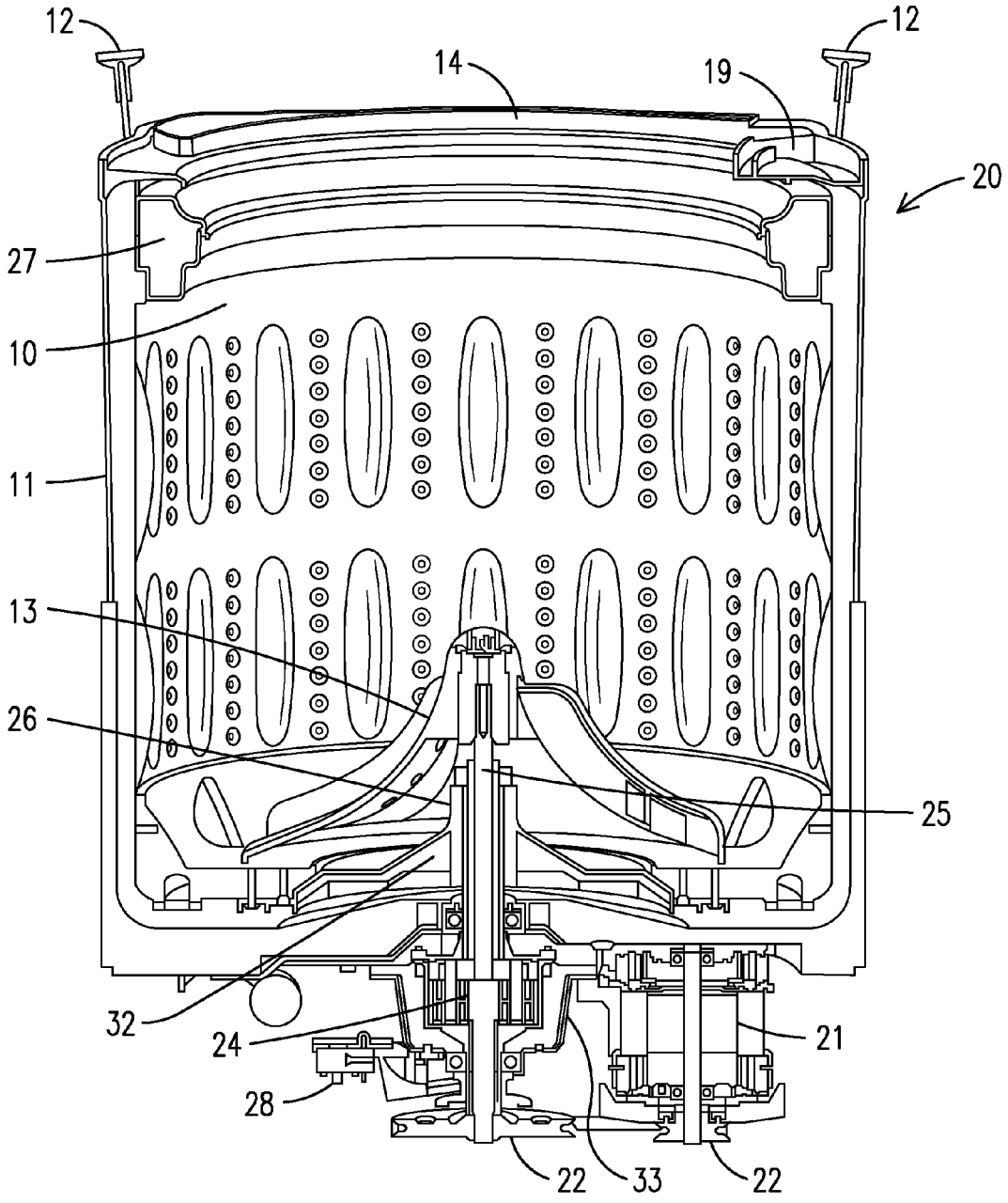
FIG. 3 is an isometric cross section of a sub-washer.

The washing machine object of the present invention, which is shown in FIGS. 1, 2, and 3 is of the top loading or vertical axis type, having a cabinet from which four suspension bars 12 are fastened to. Said suspension bars 12 support the weight of the tub 11 as well as the remaining accessories of the referred to cabinet, as well as acting as shock absorber to the vibrations which originate during the washing process. Thus the tub 11 is hanging from said suspension bars 12 by means of some ears placed in the lower part of said tub 11. Over the referred to tub 11 the remaining periphery equipment is mounted, such as the motor 21, optionally a planetary gear for reduction, which in an alternative embodiment to the present invention can be omitted, adjusting the relationship between the pulleys 22, that is, the pulley 22 with the greatest diameter will be adjusted over the inner shaft 25 which will receive energy originating from the electric motor 21 thanks to the pulley arrangement 22 and the strip. Optionally, the shaft 25 on its extreme upper part is coupled to a planetary gear 24, with the purpose of reducing angular velocity and thus gain greater par, the exit shaft of the planetary gear 24 will reintegrate into a shaft 25, which on its upper part has the agitator 13 assembled. Optionally, the inner shaft 25 on its lower part is coupled with the pulley 22 with the greatest diameter and on its extreme upper part is coupled to the agitator 13. The hollow shaft 26 houses in its interior the inner shaft 25. Said hollow shaft 26 is mechanically coupled to a clutch 28 which can cause both shafts 25, 26 to rotate together or independently. Said hollow shaft 26 is mechanically coupled to the basket's center or hub 32, so that when shafts 25, 26 are clutched and rotating together, the hollow shaft 26 will transmit energy to the basket 10 so that it may spin together with the agitator 13.

The basket 10 is crowned by a balancing ring 27 which counteracts the unbalancing caused by the shifting inside the basket 10 of the objects to be washed. The tub itself has assembled unto its extreme upper part a tub cover 14 which houses a grid 19 as well as a spray deflector 18. The cabinet itself is covered by the main cover 30 which covers the upper part of the washer 20. Said main cover 30 helps support a crest 31 which houses the electric components such as the control 40, the drivers 71 thru 79, the pressure switch 41 etc as well as the washer's door or lid 29 through which the articles to be washed are placed.

Figure 5:
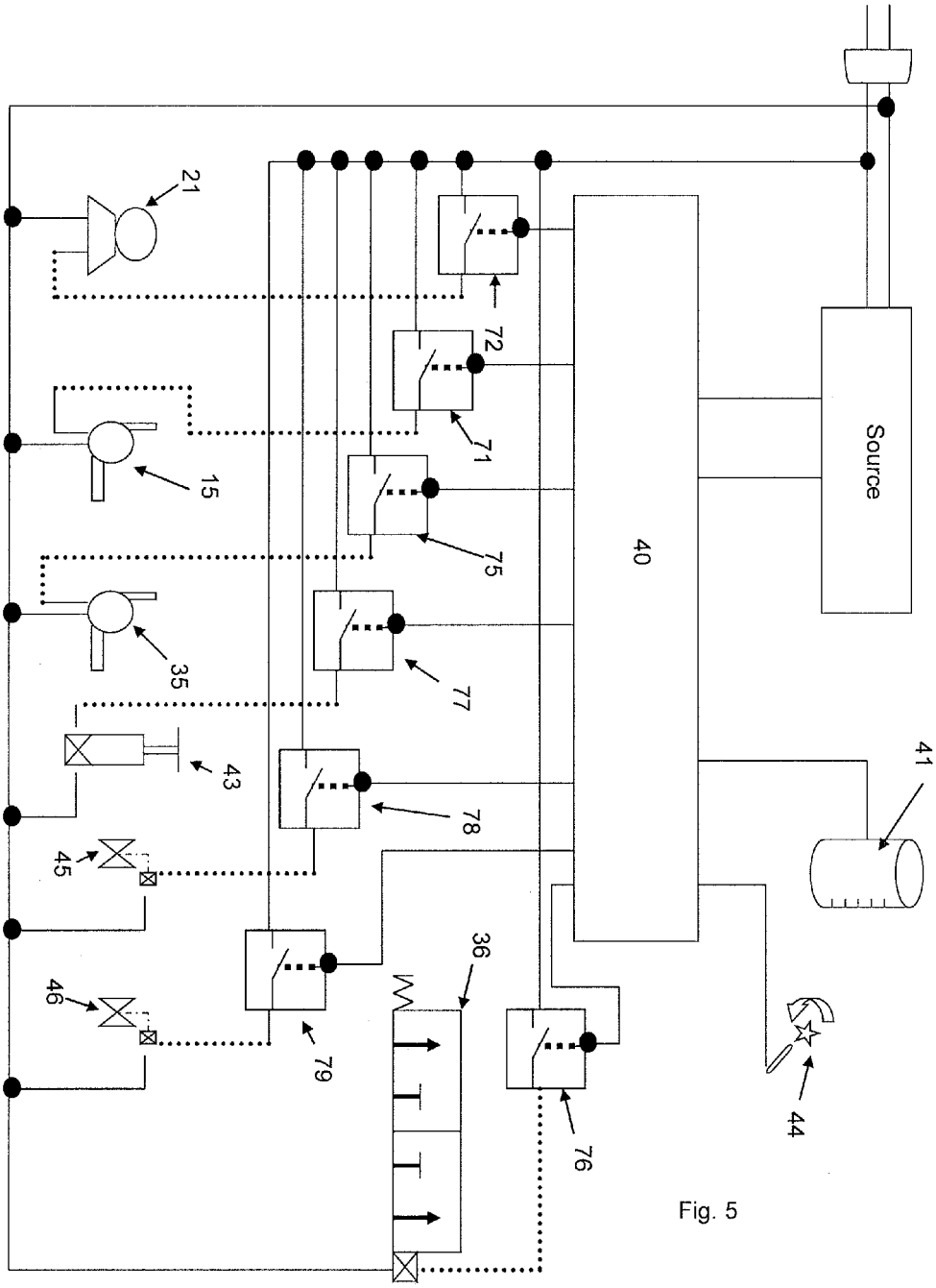
FIG. 5 is an electric diagram of the components which the high efficiency method of the present invention requires.

FIG. 5 shows detail of the connection between the electric control to the various sensors or actuators which it controls, which allows for the washer's 20 proper functioning as it sends signals to the various actuators at the times determined by the method object of the present invention. Thus the electric motor 24 is energized by a driver 72 which receives signals from the electric control 40. The referred to electric control 40 sends a pulse with a certain longitude to the driver 72 so that it, during the time that said pulse longitude lasts; it energizes the motor 24 in a certain direction. The same can occur to energize the motor 24 in the opposite direction, waiting for a determined time between swats or pulse widths.

Figure 4:
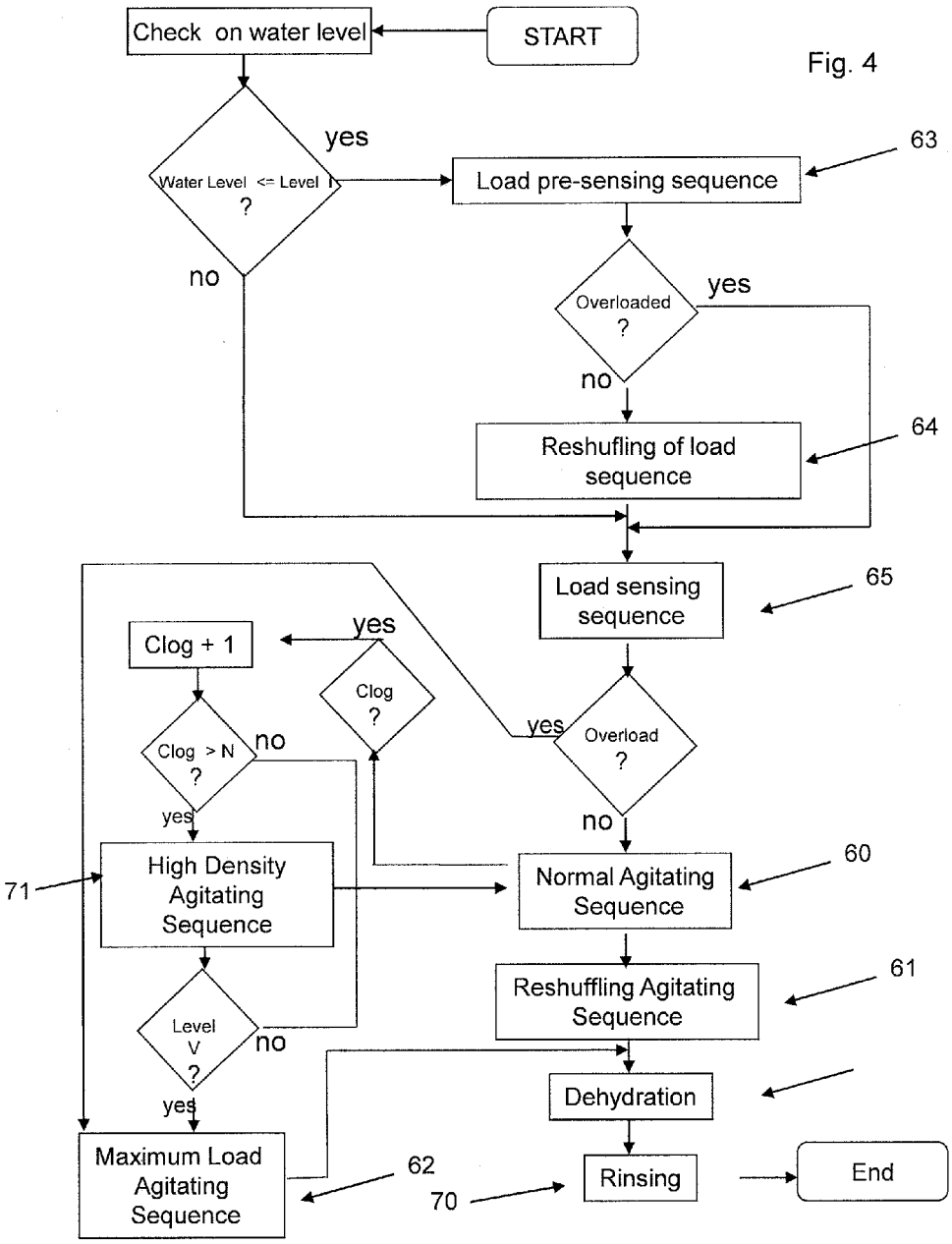
FIG. 4 is a flow diagram of the high efficiency washing method of the present invention.

The high efficiency method of wash, object of the present invention referred to on FIG. 4, begins when the operator has introduced a determined amount of articles to be washed, in its case a determined amount of wash additives, has selected the program to be used and has started the washing machine. Thus, the electric control 40 first checks if the signal which it receives from the pressure switch 41 indicates if the water level is greater than the spray level or level I, should this occur, the sequence of load sensing 65 begins, or in the opposite case, a sequence of load pre-sensing 63 takes place, a sequence which will be later detailed. This indicates whether there is an excess of clothes or load, for example in an illustrative form but not limited form, greater than 7 kg. If such an overload condition is not detected, the electric control 40 activates the agitating sequence 64 to reshuffle clothes which will be later detailed. In an alternative modality, a spray sequence 66 takes place at certain intervals in intermittent form, which shall be later detailed. During the rest of the washing cycle or during the agitating sequences 60, 61, 62, 67 this takes place with the objective of hydrating the objects to be washed which are exposed or that are found on the top. In case overloading is detected, the electric control 40 omits the agitating sequence of reshuffling 64 and proceeds directly to the load sensing sequence 65. The referred to sensing sequence 65, which shall be detailed later, takes place in order to be able to determine in a timely manner versus the pre-sensing of load sequence 63 the amount of objects to be washed which are placed inside the basket 10, thus being then able to determine the proper amount of needed water according to the objects to be washed which are placed in the basket 10. In a similar manner at this point the possibility of overload condition is checked on again. Should this exist, a second agitating sequence 62 at a maximum load takes place, which shall be later detailed, with a maximum water level or level V of water or washing mixture to later undergo the dehydrating and rinsing phases. In the opposite case, when the overloading condition does not exist, water is introduced to a predetermined level, such as level II or minimum, level III or medium, or level IV or high in light of the electric control 40's sending a signal to the driver 78 of the filling valves 45, so that these may allow the water to enter towards the tub 11. This can take place until the electric control 40 receives the proper signal that the water level determined by the pressure switch 41 (level II or minimum, level III or medium, level IV or high) has been attained. When it reaches said level, the signal to the driver 78 to the filling valves 45 stops, thus ceasing the flow of water into the tub 11. As soon as the proper water level is reached, the electric control 40 begins the normal agitating sequence 60 for a determined amount of time which preferably varies between 5 and 30 minutes. Once this time elapses, the agitating sequence of reshuffling 64 takes place for another period of determined time which varies between 1 and 20 minutes. Once said time interval elapses, dehydrating 69 takes place in order to ultimately go to rinsing 70 phase of the objects to be washed which are placed inside the basket 10.

In an alternative embodiment of the present invention, rinsing 70 can count on a centrifuge pattern which includes rinsing blocks or have a required rinsing profile with the intent of saving water, thus ending with this step the complete washing cycle.

DEFINITIONS

Arc. Angular distance which the agitator or propeller 13 is displaced which is measured in degrees from its resting state until it returns to its resting state.

Desired Arc. The desired angular distance which the agitator or propeller should be displaced while the motor 21 is energized.

Arc Measurement. Takes place in the preferred embodiment of the present invention by means of a rotor position sensor, preferably a hall type 44 installed on the motor 24, which reports a determined number of pulses to the electric control 40 each time the motor 24 is activated in each direction, the referred to number of pulses is directly proportional to the longitude of the arc, thus the number of pulses can be referenced according to any given arc longitude. Thus the electric control 40 compares the pulses measured by means of the rotor's position sensor 44 via shocks or swats versus a determined range of aim of pulses.

Swats. The agitator's or propeller's 13 circular movement in clockwise or antic-clockwise direction during a period of determined time: this is attained when the clutch 28 is found in agitating motion, the electric control 40 starts the counting of time with an inner timer and at the same time sends a signal to the motor's 21 driver 72 so that it may energize the motor 21 thus prompting the agitator or propeller 13 which will then described a determined arc which is measured thanks to the rotor's 44 position sensor, knowing that the latter sends a string of pulses to the electric control 40 which counts them, as said electric control 40 has a reference directly proportional between number of pulses counted and the arc described by the agitator or propeller 13, so that when the electric control 40 senses it has reached the desired arc, the signal to the motor's 21 driver 72 is interrupted and stops the time counter of the inner timer, knowing that the agitator or propeller 13 in order to effect its displacement and follow the trajectory of the desired arc has a specified time, if this time lapses before the agitator or propeller 13 finishes its angular displacement, the electric control 40 will begin a determined waiting time counting period which varies between 0.01 seconds to 5 seconds, once the condition of angular displacement or the course of time has taken place, said waiting time shall have to take place before beginning a new swat in the opposite direction to the one immediately previous.

Stroke per Minute. SPM, according to its initials, refers to the number of continued swats in both directions achieved in one minute, including the waiting time between swats.

Agitation. Movement which is obtained on the objects to be washed by the action of the agitator or propeller 13 on the first objects immersed in the washing mixture.

Desired arc with normal agitation. Has an arc longitude which varies between 180 to 1100 degrees with a frequency between 30 and 60 strokes per minute (spm).

Clog. According to the arc measurement if it is found that the arc of one swat is significantly less than the agitation desired arc, the electric control 40, it is assumed that a clog exists, which implies that some object to be washed is jammed and has clogged the agitator or propeller 13 or that a high concentration of objects to be washed exists with a reduced volume in the basket causing an undesired high concentration of objects to be washed in a particular area within the basket 12.

Normal Agitation Sequence 60

The normal agitation sequence has a pattern of swats or arcs (turns of the agitator 13 in both directions—clockwise and anti-clockwise), strokes per minute (spm) or number of times which it turns each side per minute and the time of agitation.

The determination of the arc is a function of the liquid density of the wash clothes, transmission of potency and the motor 21 capacity in terms of torque availability.

The desired arc of normal agitation varies between 180 to 720 degrees obtaining anywhere between 30 to 60 strokes per minute (spm) said arc allows for proper friction between the scrubbers of the agitator 13 and the objects to be washed, it also contributes to better dispersion of the objects to be washed within the basket 12, with the end result that these have adequate movement of the articles to be washed. A lesser arc would imply that one of the articles to be washed has been caught or that an unusual and undesired accumulation of objects to be washed has occurred in the basket, creating a high density of objects to be washed in a reduced volume within the basket 12, which then causes the agitator's 13 scrubbers to not be in contact with the objects to be washed, thus creating decreased friction among these and thereby creating less dirt removal. These being, coupled to other motives, so that at all times it is being sensed in order to attain the desired arc with each stroke or swat, since as was previously discussed an arc out of range is undesirable, it is desirable to take actions directed towards a better distribution of articles to be washed within the basket 12 as is the case in the high density agitating sequence 67 or the maximum load agitating sequence 62 so that each stroke or swat is monitored comparing its length of arc versus the length of the desired arc. Said measurement of arc takes place in the preferred embodiment of the present invention by means of a position sensor of the rotor 44 installed in the motor 24, which reports back a determined number of pulses to the electric control 40 each time the motor 40 acts in each direction. The number of pulses referred to is proportional to the length of the arc so that a determined number of pulses can be referenced to a given arc length. Thus the electric control 40 compares the pulses measured by strokes or swats versus a determined range of desired pulses, if the value measurement is within range agitation and strokes or swats will continue conventionally, but if the opposite is true upon detecting a shorter arc than the desired arc of normal agitation, the electric control 40 concludes that a clog exists, thus activating the high density agitation sequence 67 which shall be later detailed. Said high density agitation sequence 67 uses a position sensor of the rotor for a determined time a reduced arc, which in a preferred embodiment can return to the desired arc of normal agitation described above. Once the agitation time is concluded which continues running its course with the various determined efforts by the proposed method with the objective of uniformly segregating the clothes within the basket 12.

Agitating for Adjustment Sequence 61

This special sequence of agitation has as a purpose the diffusing or disseminating of the objects to be washed within the basket 10 in a uniform fashion within the volume of work contained within the basket 10, to avoid as much as possible, the unbalancing in the dehydrating or centrifuge stage. The basket 10 in said centrifuge stage turns at high revolutions, always having the objects to be washed within the basket 10 as evenly distributed as possible within the working volume, avoiding clumps or high density of clothes in a reduced volume which could cause an unbalancing within the basket 10. The clutch thus being in agitating manner the electric control orders a swat with a desired arc between 400 and 500 degrees, with a frequency such that between 30 and 60 strokes (or swats) can be reached per agitation minute, for a period between 1 and 20 minutes.

High Load Agitating Sequence 62

This high load agitating sequence given the peculiar characteristics of the agitator or propeller 13 requires special conditions in order to take place. Thus in case the operator has introduced a high load of objects to be washed into the basket 10 which create an overloaded condition, the referred to objects will be able to be washed without major complication using a special pattern of distribution. On the other hand, this pattern is also focused on protecting the mechanism of the washer 20 itself, since this pattern requires a lesser effort from the motor 21, avoiding over-heating, and additionally reducing the mechanic efforts between the pulleys 22, the band 23 and the shafts 25, 26 among others. Thus the electric control 40 uses a swat with a desired arc varying between 50 and 180 degrees with a frequency varying between 10 to 30 strokes (or swats) per minute, maintaining these oscillations for a determined period of time between 5 and 20 minutes.

High Density Agitation Sequence 67

This sequence takes place within the sequence of normal agitation. As was discussed in the normal agitation sequence 60, in case of detecting an arc which is lesser than described by the agitator or propeller 13 to the desired arc of normal agitation which varies between 180 and 1100 degrees attaining between 30 to 60 spm, would imply that an object to be washed has become clogged or an unusual and undesired accumulation of objects to be washed is present thus creating a high density of objects to be washed in a reduced volume within the basket 12. The ensuing causes the scrubbers of the agitator 13 to not be in contact with the objects to be washed creating lesser friction among these and allowing for minimized dirt removal. Thus it is desirable to take actions aimed at better distribution of objects to be washed within the basket 12 as would be the activating the high density agitating sequence 67 or the high load agitating sequence 62. This being the case, each stroke or swat is monitored comparing its arc length versus the desired arc length, if based on the result of the comparison of the latter two a significant difference is noted, the electric control 40 assumes that a clog is present which means that an article to be washed has been caught or clogged the agitator or propeller 13 so that a high concentration of objects to be washed in a lesser volume within the basket is present, causing an undesired high density of objects to be washed in an area within the basket 12. Were the normal agitation 60 to continue we run the risk that said undesired high density of objects to be washed will increase or the clogging of the propeller 13 or agitator worsen, so that the idea of a high density agitating sequence 67 which allows in the majority of cases to dissolve said undesired high density of objects to be washed or to remove the offending articles which caused the clog to the agitator or propeller 13. Thus when the electric control 40 detects a great difference between the measurement of the arc and that of the desired arc (a stroke with a shorter arc than the desired arc) it is supposed that a clog exists, which activates the before mentioned high density agitation sequence 67. This has swats with a desired arc which varies between 70 and 110 degrees with a frequency between 50 and 70 strokes per minute thus obtaining vigorous agitation with a reduced displacement or arc of the agitator or propeller 13, this manner of agitation with swats with a reduced desired arc takes place for a determined time which varies between 1 and 20 minutes, depending on the parameters of design of the agitator or propeller as well as those of the basket 10. This time of normal agitation having lapsed, the electric control 40 reestablishes the swat with the desired arc of normal agitation using the normal agitation sequence 60. In an alternative embodiment of the present high density agitation sequence 67 the desired arc varies between 70 and 110 degrees and can increase with each swat a fixed value which varies between 4% and 10% of the value of said desired arc, this occurs until the desired arc is the same or almost similar to the desired arc of normal agitation. So that when the electric control 40 detects by means of the count of emitted pulses by the rotor's 44 position sensor that the desired arc of normal agitation used in the normal agitation sequence 60 has been reached it continues with the referred t normal agitation sequence 60. Yet in another preferred embodiment to the present high density sequence 67, the desired arc varies between 70 and 110 degrees and can increase by a fixed value which varies between 4% and 10% of the value of the objective previously mentioned for periods of determined time which can vary from 5 to 60 seconds. Thus when the period of time lapses, the value of the reduced arc is increased, thus begins a new determined period of time. This occurs until the desired arc is equal or close to equal to the desired arc of the normal agitation using a normal agitation sequence 60. Thus when the electric control 40 detects thanks to the count of emitted pulses by the rotor's 44 position sensor, that the desired arc of normal agitation used in the normal agitation sequence 60 has been reached, it continues with the normal agitation sequence 60 referred to.

If the electric control 40 by means of measurement of the arc detects another clog in an alternative embodiment of the present invention it can begin to undergo the sequence described above a set number of times preferably between 1 and 5 more times.

When the electric control 40 by means of measurement of the arc detects another clog having at least undergone the agitation sequence 67 described above at least one time, the washing mixture is increased by means of introduction of fresh water, this is done with the intent of providing a n increased volume of washing mixture within the tub 11 which provides a greater work mass volume within the basket 10, since the articles to be washed can move with greater ease within a greater mass volume of washing mixture. Thus when the electric control 40 detects a new clog within the normal agitating sequence 60, the electric control 40 verifies by means of the pressure switch 41 the level of washing mixture in the tub 11. If this is equal or greater than the maximum level or level V, the electric control 40 activates the high load agitating sequence 62 previously thoroughly described. If the opposite is true, the electric control 40 sends a signal to the driver 78 so that this in turn energizes the filling valve 45, thus allowing the flow of water towards the tub 11, this occurs until the pressure switch indicates that the next level of water or washing mixture has been reached, at which point this causes the electric control 40 to quit signaling the driver 78, de-energizing said filling valve 45 and thus interrupting the flow of water towards the tub 11. Afterwards, the electric control again begins the normal agitation sequence 60 for the remaining time left on the normal agitation sequence 60.

Pre-Sensing of Load Sequence 63

This sequence is based on a measurement of inertia of the basket 10 itself. When the basket 10 is empty its inertia is less than the inertia measured when the basket is loaded with objects to be washed. The pre-sensing of load sequence helps determine whether an over-load condition exists, that is, for example, in illustrative but not limited form, when the operator has placed in the basket 10 a load or objects to be washed greater than 7 kg and this condition is detected, the electric control 40 does not use the reshuffling of clothes sequence which shall be detailed later, knowing that the high density of the objects to be washed within the basket 10 in the case of sensing overload condition, does not allow for the objects to be washed to accumulate (or compress) in particular or specific areas within the basket 10, thus resulting unnecessary and counterproductive to use a re-shuffling of load sequence going directly to the agitating sequence. Thus the sensing of overload occurs once the operator has introduced the objects to be washed into the basket 10. Given that the clutch 28 is in centrifuge form, the operator, upon pressing the start button, sends a signal to the electric control 40 which initially recuperates a signal from the pressure switch 41 to then be able to determine the proper level of washing mixture or water within the tub 11. If the washing mixture or water level is greater than level I, the electric control will not undergo the pre-sensing of load sequence, instead going directly to the agitating sequence, but if the opposite is true, if there is no washing mixture or water within the tub 11 or if the level is the same or lower than that of level I, the electric control 40 sends pulses of 100 ms to 700 ms to the motor's 21 driver 72 so that this may energize the motor 21, keeping in mind that the clutch is in dehydrating form and will cause both the basket 10 as well as the agitator or propeller 13 move in unison, given that the inner shaft 25 is clutched to the hollow shaft 26, thus both the basket 10 as well as the agitator or propeller 13 will turn in one direction for a given time, this time comprising two components, the first being the duration of the pulses emitted by the electric control 40 to the motor's 21 driver 72 and the second component is determined by the inertia, since the time it takes the basket to reach resting position describing: this is also a length of arc which directly depends on this second component. Thus the motor's 21 rotor's 44 sensor position sends a pulse through the length of the determined arc. Said pulses emitted by the rotor's 44 position sensor are sent to the electric control 40 which keeps a count on them. Thus a determined number of pulses are proportional to a certain length of arc or with a deceleration time of the basket's 10. Thus the pulses emitted by the rotor's 44 position sensor placed in the motor 21 are counted from the point in which the motor 21 is de-energized for a set period of time (preferably approximately 15 milliseconds) and allow for the detection of overload condition. In this way, the number of pulses emitted by the rotor's 44 sensor position within a set period of time can be stored in said electric control's 40 memory which enables it to later compare to a set value, which if it is the same or greater indicates the existence of an overload condition which is also stored in the electric control's 40 memory. Thus once the basket 10 is once again in resting state, the electric control once again emits a new pulse in opposite direction to the previous pulse emitted to the motor's 21 driver 72, this last one causing the basket 10 and the agitator or propeller 13 to turn in the opposite direction of the pulse immediately before it received for a determined amount of time, which in similar fashion to the pulse previously emitted by the electric control 40 to the motor's 21 driver 72 will have two components, the first being the time or width of pulse which keeps the motor 21 energized and the second component being the deceleration time. Once again the number of pulses emitted by the rotor's 44 sensor position to the electric control 40 is counted in a set amount of time which preferably varies between 200 and 990 milliseconds. Similarly, the number of pulses counted by the electric control 40 emanating from the rotor's 44 sensor position in a determined amount of time is counted and is compared to a set value. If this is equal or greater, then an overload condition exists and these values are stored in the electric control's 40 memory. Thus, if the result of the pulse emitted just previously by the electric control 40 to the motor's 21 driver 72 or the actual, cause an overload condition, the electric control 40 considers this as a real overload condition, consequently omitting the re-shuffling of clothes sequence 64 and proceeds directly to the sensing of load sequence 65, in the opposite case, the electric control 40 begins a reshuffling of load sequence 64.

Re-Shuffling of Clothes Sequence (Donut) 64

This sequence helps to uniformly distribute the objects to be washed within the basket 10, avoiding the concentration of objects to be washed accumulating in a small space, which cause high density of objects to be washed or accumulations of objects to be washed within the basket 10, hindering efficient contact with the agitator or propeller 13, which cause an undesirable movement of objects to be washed within the basket 10 since proper flow of washing mixture generated by the agitator or propeller 13 is not possible, and consequently the flow of washing mixture through the fibers of the objects to be washed do not have enough force, consequently reducing the effectiveness of the wash. It is for these reasons, coupled to others, that it is desirable to carry out an efficient reshuffling of clothes within the basket 10 previous to the agitating sequence with the purpose of attaining a better washing condition of the objects to be washed taking into consideration a moderate or low water level. After undergoing the load pre-sensing sequence and having determined from the electric control 40 that an overload condition does not exist, the basket 10 being in resting stage, the electric control 40 sends a pulse which varies between 8 and 12 seconds to the driver 78 of the filling valve or water admitter 45 to allow the flow of fresh water into the interior of the tub 11, which, in an alternative embodiment of the invention, can be hydraulically connected to the chemical dispenser 34, also sending the electric control 40 a pulse for the same time lapse to the driver 74 of said chemical dispenser, and yet, in another alternative embodiment of the invention, the electric control 40 sends a pulse for a determined amount of time to the whitener liquid admission valve 46, so that it allows the admission of this liquid in case the operator has deposited a certain whitener liquid volume in the corresponding chemical dispenser 34 compartment. Thus, when the admission valve of the liquid whitener 46 opens, a certain volume of water is allowed in, which is transported through the chemical dispenser 34, dragging with it the volume of bleach which was placed in the chemical dispenser 34, which then directs the washing liquid so that in a waterfall form, it falls through the buffer on the mesh 19, which allows the washing liquid to pass between the tub 11 and the basket 10, avoiding contact with the objects to be washed, thus depositing the washing mixture in the tub's bottom which allows for uniform mixture of the chemicals with the water without directly pouring the chemicals unto the objects to be washed which can cause spotting due to chemical attack on the surface of the objects to be washed due to poor dilution and consequent chemical mixture with the water.

Once the mentioned width of pulse is lapsed, the electric control sends a pulse which varies between 2 and 20 seconds to the pump's 15 driver 71, which allows it to replenish the washing mixture during the width of said pulse to the spray deflector 18 spraying the objects to be washed placed inside the washing cone of said pray deflector 18 with the washing mixture. Once the duration of said pulse is expired, these steps are repeated for a determined amount of time which varies between 30 and 60 seconds, or at least one basket 10 revolution, so that the objects to be washed placed in the basket 10 are soaked with the washing mixture which had accumulated in the tub's bottom 11. Followed by, once all or the majority of accumulated water volume has been transferred from the tub's bottom 11 to the objects to be washed, the electric control 40 sends a pulse which varies between 5 and 15 seconds to the motor's 21 driver 72, keeping in mind that the clutch 28 is placed in dehydrating fashion; this allows the basket 10 to rotate the objects contained in the basket 10, where when rotating at a certain velocity for a certain amount of time, the washing mixture is extracted from the textiles, and collects at the bottom of the tub 11. When the basket is rotating, the rotor's 44 sensor position sends a set of pulses to the electric control 40, and this in turn determines the velocity at which the motor turns thanks to its internal logic. Thus, when the motor reaches a velocity which varies between 90 to 150 rpm, the electric control de-energizes the motor's 21 driver 72 causing the immediate deceleration of the basket 10 until the basket reaches its resting position, having detected this condition, the electric control 40, thanks to the absence of pulses of the rotor's 44 sensor position, in an alternative embodiment of the present invention, the steps to this sequence are repeated at least one time.

Sensing of Load Sequence 65

The purpose of this sequence is to determine by means of a particular agitation pattern the quantity and type of objects to be washed, so that as a function of resistance which said load opposes the movement of the agitator or propeller 13, it defines the water levels corresponding to agitation during the washing phases, the centrifuge pattern and the number of rinsing blocks.

This sequence operates in two ways, the first being when the electric control 40 does not register an overload condition, the second when the electric control 40 detects an overload condition. In the first instance, when no overload exists, the electric control 40 in some way has to measure in a qualitative way, the amount objects to be washed within the basket 10, to be able to determine the water level, and to use during the agitation sequence, the number of rinsing blocks, as well as the profile of centrifuge ramps in the dehydrating sequence. Thus the ingenious development of the present sequence was devised without the need to use more sensors than the motor's 21 position sensor 44. In this way, the mentioned sequence begins when the electric control 40 checks on the possibility of overload existence, and upon not finding such condition (first instance) it sends a signal to the filling valve's 45 driver 78, so that these allow the flow of water into the tub 11 to be stored in the tub's bottom, this condition persists until the pressure switch 41 sends a signal to the electric control 40 that the minimum level or level II has been reached, keeping in mind, that the clutch 28 is in agitating form, when said minimum level or level II is reached the electric control 40 stops the signal to the filling valve's 45 driver 78, now sending a signal to the motor's 21 driver 72. Simultaneously, the electric control 40 keeps count of the pulses sent by the rotor's 44 position sensor thus measuring the arc, with a desired arc varying between 180 to 72 degrees with a frequency varying between 20 to 60 spm until a certain number of strokes or swats are counted, like for example, between 10 and 40 strokes or for a determined period of time, which preferably varies between 30 to 50 seconds. This period of time having transpired, agitation continues with a desired arc varying between 180 to 720 degrees, counting a certain number of strokes which can preferably vary between 10 and 40 or for a second period of time which preferably lasts between 20 to 40 seconds. It is during this second period of time, where after each swat takes place or rotation which varies between 180 to 720 degrees, where the electric control 40, upon detecting that the rotation angle mentioned above has been reached and the signal to the motor's 21 driver 72 has been interrupted, that it begins counting the pulses sent by the rotor's 44 position sensor until the agitator or propeller 13 reach their resting position, which causes an interruption in the set of pulses which the rotor's 44 position sensor sends the electric control 40. Thus the electric control 40 with each swat or angular path, registers the number of pulses which the rotor's 44 position sensor has sent while the motor 21 is de-energized, said fact is stored in said electric control's 40 memory, next to the fact of the swat or angular path immediately following in the opposite direction. This set of facts is continually being averaged and stored in the memory so that each swat or angular path followed is averaged with the subsequent one, erasing the facts from the previous set of swats. This takes place until the second period of time has lapsed, and when this takes place, the last fact is averaged remains in the electric control 40 and is compared with predetermined values which indicate the water level to be used. This is followed by the electric control 40 sending a signal to the filling valve's 45 driver 78 until the determined water level for the load of objects to be washed has been reached, thanks to the signals which the pressure switch sends the electric control 40.

Spraying Sequence 66

This sequence serves as an alternative embodiment to the washing method, object of the present invention. The sequence takes place in the agitating sequences or while the clutch is in an agitation form in the following way: taking into account that within the tub 11*a* certain volume of washing mixture is present, having been detected by the pressure switch 41 which in turn sends a signal to the electric control 40, if said level of washing mixture or volume of washing mixture is greater than or equal to the minimum level or water level II, the electric control 40 sends a pulse for a determined period of time which can vary between 0.5 seconds to 2 seconds to the driver 71 of the spray pump 15 so that it may in turn send water to the spray deflector 18 via the spray hose 17 so that in it may dampen the objects to be washed placed within the basket 10 which are exposed or which are found on the upper part. This is followed by the electric control 40 counting a set amount of waiting time; once this time has lapsed, the sequence is repeated sending a new pulse for a similar amount of time to the driver 71 of the spray pump 15, repeating this process for a determined amount of time which varies between 2 to 5 minutes.

An alternative embodiment of the present spraying sequence 66 comprises the use of a directional valve 36 which is connected to the drain pump's 36 exit by means of a duct or a hose (not shown). One of the exits of said directional valve is connected to the spray hose 17 and the remaining one to the drain hose 16, taking into account that within the tub 11 there is a certain determined volume of washing mixture which is greater than or equal to the minimum level or water level II, the electric control 40 sends a pulse for a determined amount of time which can vary between 0.5 seconds to 2 seconds, to the driver 75 of the drain pump 35, and at the same time sends a pulse for the same amount of time to the driver 76 of the directional valve 36 so that it may send water towards the spray deflector 18 by means of the spray hose 17 so that it may dampen the objects placed in the basket 10 which are exposed or that are placed on the upper part. This is followed by the electric control 40 counting a determined amount of waiting time. This time having lapsed, the sequence is repeated sending a new pulse for a similar amount of time to the drain pump's 35 driver 75 and in its case (depending on the type of valve to be used), a pulse is sent in the same instant for the same amount of time to the directional valve's 36 driver 76 so that it may send water to the spray deflector 18 by means of the spray hose 17, repeating this process for a set amount of time which varies between 2 and 5 minutes.

This sequence can be activated by the electric control 40 in intermittent form while the filling valves 45 are energized, or during the load sensing sequences 65, normal agitation sequences 60, or reshuffling of load sequences 61, in the high load agitating sequences 62 or in the high density sequences 67.

Dehydrating 69

The dehydrating stage helps to extract the washing mixture. This sequence takes place by making the basket 10 turn, so that by centrifuge force, the washing mixture is pushed to the wall with holes in the basket 10 to be extracted by means of said holes towards the tub 11, where the extracted washing mixture is pumped towards the exterior by means of the drain pump 35 which on its exit is connected to a drain hose 16. Then the electric control 40 sends a pulse for a set amount of time varying between 2 and 8 minutes to driver 75 of the drain pump 35, at the same time it also sends a signal to the driver 73 of the clutch 28 so that it may change from agitation mode to dehydrating mode. In an alternative embodiment to the present invention, the clutch can be a floating clutch which with the presence or absence of washing mixture can either clutch or un-clutch the shafts 25 and 26, being evident that said floating clutch will not use an actuator and thus the electric control will not be able to send a signal to either activate it or de-activate it. Thus the clutch being in dehydrating form, the electric control also sends a pulse for a set amount of time to the driver 72 so that it may energize the motor 21, thus turning the basket 10 in unison with the agitator or propeller 13. Said pulse sent be the electric control 40 can vary depending on the type of centrifuge which is needed. In this way, in a an alternative embodiment, a set of pulses with varying widths can be sent with the goal of accelerating and decelerating the basket 10 to extract less water upon deceleration of the basket giving the drain pump 35 enough time to extract the washing mixture accumulated in the tub's bottom 11, and additionally avoiding accumulation of foam problems between the tub 11 and the basket 10, main cause of the phenomenon known as "sudsing".

In an alternative embodiment of the present invention, the motor 24 can be energized intermittently allowing for the deceleration of the basket 12 giving the pump enough time to extract the washing mixture accumulated in the tub's bottom, with the purpose of avoiding "sudsing", which occurs when water accumulation in the tub's bottom makes contact with the washing mixture while the basket turns, where friction creates high superficial tension which the washing mixture has, coupled to the velocity with which said washing mixture is projected unto the tub's 11 circular wall, thus generating a high concentration of foam between the ring space of the basket's and the tub's, which can even cause the basket 12 to stop even with the motor 24 energized. It can also have any other method of prevention or "sudsing" management available in the industry.

Rinsing 70

In the rinsing stage the detergent residues, chemical additives or dissolved chemicals remaining on the objects to be washed are removed, this can take place in different ways. Traditionally the tub 11 is filled with fresh water to a set level, followed by agitation by means of the agitator or propeller 13 for a set amount of time. This is followed by the extraction of washing mixture and the centrifuge of the objects to be washed in the basket 10. Alternative embodiments can be found in previous art, in such a way that the procedure described in the art be a rinsing which requires a significantly lesser amount of water than the one used by traditional rinsing methods.

Having thoroughly described the present invention, it is found to have a high degree of inventive activity, its industrial application being undeniable, assuring at the same time that someone with knowledge in the field can glimpse at alternative embodiments which can be included within the reach and spirit of the following claims.

The invention claimed is:

1. In a washer comprising a cabinet which supports a tub which houses a concentrically rotatable basket within said tub, the basket being driven by a motor which is mechanically coupled to an agitator and to said basket, a clutch which allows the coupling and un-coupling between the basket and the agitator, an electric control, a level sensor or pressure switch, a position sensor of a rotor within the motor, and a spray system, a washing method comprising:

a. checking a water level, b. performing a load pre-sensing sequence, in which the following steps are performed:

i. coupling the basket and agitator in dehydrating form;

ii. determining water level within the tub by way of the level sensor or the pressure switch;

iii. transmitting a pulse to a motor driver for a determined amount of time in a range from approximately 100 milliseconds to approximately 700 milliseconds to energize said motor so that in turn said motor drives the agitator and the basket in unison in a first direction of rotation;

iv. counting a stream of pulses over a determined period of time in a range from approximately 200 milliseconds to approximately 900 milliseconds by means of the electric control, said stream pulses being emitted by the rotor position sensor, when the first determined time has lapsed in step b, iii; and v. comparing a number of pulses counted in the determined period of time of step b, iv, against a determined value to determine if an overload condition exists;

c. performing a reshuffling agitating sequence, in which the following steps are performed:

i. coupling the basket and agitator in dehydrating form;

ii. transmitting a pulse to a pump driver for a determined period of time in a range from approximately 2 seconds to approximately 20 seconds to spray objects to be washed in the basket with washing mixture until the objects are soaked; and iii. transmitting a pulse to the motor driver for a determined time in a range from approximately 5 seconds to approximately 15 seconds to rotate the basket, agitator and objects within the basket in unison until reaching a determined velocity and then decelerating the basket until reaching a resting state;

d. performing a load sensing sequence, in which the following steps are performed:

i. determining if in the pre-sensing load sequence an overload condition was detected;

ii. verifying that the clutch is in agitating form;

iii. transmitting a signal to an admission valve driver to allow water ingress into the tub until at least a desired water level is reached;

iv. agitating the agitator to a determined arc with a determined frequency for a determined time in a range from approximately 30 seconds to approximately 50 seconds or for a determined number of strokes in a range from approximately 10 strokes to approximately 40 strokes;

v. transmitting a signal to the motor driver after step d, iv to energize said motor so that in turn the motor can cause the agitator to rotate in a first direction through a determined arc;

vi. discontinuing the signal to the motor driver to de-energize the motor, and counting pulses emitted by the rotor position sensor until the agitator reaches the resting state;

vii. storing in a memory of the electronic control the number of pulses emitted by the rotor position sensor in step d, vi;

viii. transmitting a signal to the motor driver to energize said motor so that the motor causes the agitator to rotate in a second direction through a determined arc;

ix. discontinuing the signal to the motor driver to de-energize the motor, and counting the pulses emitted by the rotor position sensor until the agitator has reached the resting position;

x. storing in the memory of the electronic control the number of pulses emitted by the rotor position sensor during step d, ix; and xi. averaging and comparing the number of pulses stored against a set determined value to determine a required water level;

e. performing a normal agitating sequence, in which the following steps are performed:

i. verifying that the clutch is in agitating form;

ii. generating a series of strokes in respective clockwise and anti-clockwise directions which cause agitation of the objects to be washed within the basket for a determined period of time;

iii. monitoring a length of arc of each stroke while the motor is energized; and iv. comparing the length of arc obtained in each stroke while the motor is energized against a desired normal arc; and (f) performing a reshuffling of the objects, in which the following steps are performed:

i. verifying that the clutch is in agitating form; and ii. generating a series of strokes in clockwise and counterclockwise directions with a desired arc which varies in a range from approximately 400 degrees to approximately 550 degrees with a frequency in a range from approximately 30 swats or strokes per minute to approximately 60 swats or strokes per minute so that agitation can be performed for a period of time in a range from approximately 1 minute to approximately 20 minutes and causing agitation of the objects to be washed within the basket.

2. The method according to claim 1, which also comprises:

performing a spray sequence which can be activated in conjunction with any of said sequences.

3. The method according to claim 1, which also comprises:

activating a high density agitating sequence if during the normal agitating sequence a clog is detected.

4. The method according to claim 1, which also comprises:

activating a high load agitating sequence if during the load sensing an overload condition is detected.

5. The method according to claim 1, which also comprises:

activating a load sensing sequence if during the load pre-sensing an overload condition is detected.

6. The method according to claim 1, which also comprises:

activating a high load agitating sequence if during the normal agitating sequence a maximum water level present is detected.

* * * * *